US009099045B2

(12) United States Patent
Ueda et al.

(10) Patent No.: US 9,099,045 B2
(45) Date of Patent: Aug. 4, 2015

(54) BACKLIGHT APPARATUS, BACKLIGHT CONTROLLING METHOD AND LIQUID CRYSTAL DISPLAY APPARATUS

(75) Inventors: Mitsunori Ueda, Tokyo (JP); Tadashi Morimoto, Tokyo (JP); Minoru Mizuta, Tokyo (JP)

(73) Assignee: Thomson Licensing, Issy-les-Moulineaux (FR)

( * ) Notice: Subject to any disclaimer, the term of this patent is extended or adjusted under 35 U.S.C. 154(b) by 783 days.

(21) Appl. No.: 12/011,039

(22) Filed: Jan. 23, 2008

(65) Prior Publication Data

US 2008/0174544 A1 Jul. 24, 2008

(30) Foreign Application Priority Data

Jan. 24, 2007 (JP) ..... 2007-013832

(51) Int. Cl.
*G09G 3/36* (2006.01)
*G09G 3/34* (2006.01)

(52) U.S. Cl.
CPC ..... *G09G 3/3426* (2013.01); *G09G 2310/0232* (2013.01); *G09G 2310/0237* (2013.01); *G09G 2320/0242* (2013.01); *G09G 2320/0285* (2013.01); *G09G 2320/064* (2013.01); *G09G 2320/0633* (2013.01); *G09G 2320/0646* (2013.01); *G09G 2330/021* (2013.01); *G09G 2360/145* (2013.01); *G09G 2360/16* (2013.01)

(58) Field of Classification Search
CPC ..... G09G 3/342; G09G 3/3426; G09G 2320/0242; G09G 2320/0633; G09G 2320/064; G09G 2360/16
USPC ..... 345/88, 102, 211
See application file for complete search history.

(56) References Cited

U.S. PATENT DOCUMENTS

| | | | |
|---|---|---|---|
| 4,870,484 | A | 9/1989 | Sonehara |
| 5,143,433 | A | 9/1992 | Farrell |
| 5,475,512 | A | 12/1995 | Nakazawa et al. |
| 6,055,033 | A | 4/2000 | Yamaguchi et al. |
| 6,580,476 | B2 | 6/2003 | Hasegawa |
| 6,608,614 | B1 | 8/2003 | Johnson |
| 6,633,301 | B1 | 10/2003 | Dallas et al. |

(Continued)

FOREIGN PATENT DOCUMENTS

| | | | |
|---|---|---|---|
| DE | 10 2004 023186 | A1 | 12/2005 |
| EP | 1672706 | A | 6/2006 |

(Continued)

OTHER PUBLICATIONS

Poynton, "Digital Video and HDTV, Algorithms and Interfaces", Jan. 1, 2003, pp. 203-207, 224; Morgan Kaufmann, San Francisco, CA, USA.

(Continued)

*Primary Examiner* — Chanh Nguyen
*Assistant Examiner* — John Kirkpatrick

(57) ABSTRACT

Disclosed herein is a backlight apparatus for controlling a backlight wherein light emitting devices for emitting light of red, green and blue and a switching device for switching on or off light emission of the light emitting devices are provided for each of a plurality of divisional regions formed by division of a lighting region such that the light emission luminance can be varied for each of the regions, the backlight apparatus including: light emission luminance control means; current value storage means; and current control means.

23 Claims, 8 Drawing Sheets

(56) References Cited

U.S. PATENT DOCUMENTS

| | | | | |
|---|---|---|---|---|
| 6,636,282 | B2 | 10/2003 | Ogawa et al. | |
| 6,666,567 | B1 | 12/2003 | Feldman et al. | |
| 6,697,134 | B2 | 2/2004 | Watanabe et al. | |
| 6,799,865 | B2 | 10/2004 | Ellens et al. | |
| 6,817,735 | B2 | 11/2004 | Shimizu et al. | |
| 6,975,079 | B2 | 12/2005 | Lys et al. | |
| 7,142,188 | B2 | 11/2006 | Tsumura et al. | |
| 7,184,110 | B2 | 2/2007 | Kim et al. | |
| 7,201,493 | B2 | 4/2007 | Martynov et al. | |
| 7,213,960 | B2 | 5/2007 | Yoo | |
| 7,281,816 | B2 | 10/2007 | Suzuki | |
| 7,295,260 | B2 | 11/2007 | Harayama et al. | |
| 7,324,080 | B1 | 1/2008 | Hu et al. | |
| 7,474,366 | B2 | 1/2009 | Haga et al. | |
| 7,502,010 | B2 | 3/2009 | Kirk | |
| 7,511,695 | B2 * | 3/2009 | Furukawa et al. | 345/102 |
| 7,969,430 | B2 * | 6/2011 | Korcharz et al. | 345/211 |
| 2001/0035853 | A1 | 11/2001 | Hoelen et al. | |
| 2002/0006044 | A1 * | 1/2002 | Harbers et al. | 362/555 |
| 2003/0063062 | A1 | 4/2003 | Tsumura et al. | |
| 2005/0057484 | A1 * | 3/2005 | Diefenbaugh et al. | 345/102 |
| 2005/0062698 | A1 | 3/2005 | Hong et al. | |
| 2005/0073495 | A1 | 4/2005 | Harbers et al. | |
| 2005/0093473 | A1 * | 5/2005 | Yeh et al. | 315/185 R |
| 2005/0184952 | A1 | 8/2005 | Konno et al. | |
| 2005/0219443 | A1 | 10/2005 | Tanaka et al. | |
| 2006/0007111 | A1 | 1/2006 | Moon et al. | |
| 2006/0007367 | A1 | 1/2006 | Cho | |
| 2006/0044254 | A1 | 3/2006 | Kirk | |
| 2006/0103612 | A1 * | 5/2006 | Ozaki | 345/83 |
| 2006/0109389 | A1 * | 5/2006 | Ichikawa et al. | 349/1 |
| 2006/0120082 | A1 | 6/2006 | Choo et al. | |
| 2006/0152468 | A1 | 7/2006 | Ozaki | |
| 2006/0164580 | A1 | 7/2006 | Ueda et al. | |
| 2006/0274027 | A1 * | 12/2006 | Yamaguchi | 345/102 |
| 2007/0115662 | A1 | 5/2007 | Roberts et al. | |
| 2007/0285378 | A1 * | 12/2007 | Lankhorst et al. | 345/102 |
| 2007/0297172 | A1 | 12/2007 | Furukawa | |
| 2008/0007497 | A1 * | 1/2008 | Pauritsch | 345/82 |
| 2008/0036943 | A1 | 2/2008 | Matsumoto et al. | |
| 2008/0094345 | A1 | 4/2008 | Tseng et al. | |
| 2008/0100551 | A1 | 5/2008 | Haga et al. | |
| 2008/0111960 | A1 | 5/2008 | Yoshida et al. | |
| 2008/0129680 | A1 | 6/2008 | Kimura et al. | |
| 2008/0186433 | A1 | 8/2008 | Haga et al. | |
| 2008/0225197 | A1 | 9/2008 | Maruyama et al. | |
| 2009/0251400 | A1 | 10/2009 | Liu et al. | |

FOREIGN PATENT DOCUMENTS

| | | | |
|---|---|---|---|
| EP | 1863009 | A | 12/2007 |
| JP | 07-325214 | A | 12/1995 |
| JP | 10-260402 | A | 9/1998 |
| JP | 11-183891 | A | 7/1999 |
| JP | 2001-135118 | A | 5/2001 |
| JP | 2001-272938 | A | 10/2001 |
| JP | 2002-099250 | A | 4/2002 |
| JP | 2003-015118 | A | 1/2003 |
| JP | 2003-131229 | A | 5/2003 |
| JP | 2003-207770 | A | 7/2003 |
| JP | 2003-228067 | A | 8/2003 |
| JP | 2003-233062 | A | 8/2003 |
| JP | 2003-532153 | A | 10/2003 |
| JP | 2003-331608 | A | 11/2003 |
| JP | 2004-118133 | A | 4/2004 |
| JP | 2004-163902 | A | 6/2004 |
| JP | 2004-212503 | A | 7/2004 |
| JP | 2004-246117 | A | 9/2004 |
| JP | 2005-091526 | A | 4/2005 |
| JP | 2005-100932 | A | 4/2005 |
| JP | 2005-234134 | A | 9/2005 |
| JP | 2005-242270 | A | 9/2005 |
| JP | 3766042 | | 2/2006 |
| JP | 2006-058484 | A | 3/2006 |
| JP | 2008-051905 | A | 3/2008 |
| JP | 2008-052131 | A | 3/2008 |
| JP | 2008-116914 | A | 5/2008 |
| JP | 2008-122713 | A | 5/2008 |
| WO | WO 01/84227 | A1 | 11/2001 |
| WO | WO 2006/006537 | A1 | 1/2006 |
| WO | WO 2007/141732 | A2 | 12/2007 |

OTHER PUBLICATIONS

Moriya, N et al., "New Color Filter for Light-Emitting Diode Back Light", Japanese Journal of Applied Physics, Apr. 1, 2003, p. 1637-1641, vol. 42 No. 4A, Japan Society of Applied Physics, Tokyo, Japan.

* cited by examiner

FIG. 4

| REGION | R | G | B |
|---|---|---|---|
| $A_{11}$ | $I'_{R11}(=I_{R11}\times K_{11})$ | $I'_{G11}(=I_{G0}\times K_{11})$ | $I'_{B11}(=I_{B11}\times K_{11})$ |
| $A_{12}$ | $I'_{R12}(=I_{R12}\times K_{12})$ | $I'_{G12}(=I_{G0}\times K_{12})$ | $I'_{B12}(=I_{B12}\times K_{12})$ |
| ⋮ | ⋮ | ⋮ | ⋮ |
| $A_{55}$ | $I'_{R55}(=I_{R55}\times K_{55})$ | $I'_{G55}(=I_{G0}\times K_{55})$ | $I'_{B55}(=I_{B55}\times K_{55})$ |
| $A_{56}$ | $I'_{R56}(=I_{R56}\times K_{56})$ | $I'_{G56}(=I_{G0}\times K_{56})$ | $I'_{B56}(=I_{B56}\times K_{56})$ |

| REGION | R | G | B | COEFFICIENT |
|---|---|---|---|---|
| $A_{11}$ | $I_{R11}$ | $I_{G0}$ | $I_{B11}$ | $K_{11}$ |
| $A_{12}$ | $I_{R12}$ | $I_{G0}$ | $I_{B12}$ | $K_{12} = 1$ |
| ⋮ | ⋮ | ⋮ | ⋮ | ⋮ |
| $A_{55}$ | $I_{R55}$ | $I_{G0}$ | $I_{B55}$ | $K_{55}$ |
| $A_{56}$ | $I_{R56}$ | $I_{G0}$ | $I_{B56}$ | $K_{56}$ |

BACKLIGHT APPARATUS, BACKLIGHT CONTROLLING METHOD AND LIQUID CRYSTAL DISPLAY APPARATUS

CROSS REFERENCES TO RELATED APPLICATIONS

The present invention contains subject matter related to Japanese Patent Application JP 2007-013832 filed with the Japan Patent Office on Jan. 24, 2007, the entire contents of which being incorporated herein by reference.

BACKGROUND OF THE INVENTION

1. Field of the Invention

This invention relates to a backlight apparatus, a backlight controlling method and a liquid crystal display apparatus.

2. Description of the Related Art

A liquid crystal display (LCD) apparatus generally includes a color filter substrate which is colored in red (hereinafter referred to simply as R), green (hereinafter referred to simply as G) and blue (hereinafter referred to simply as B), a liquid crystal panel having a liquid crystal layer, and a backlight disposed on the back face side of the liquid crystal panel.

In the liquid crystal display apparatus, the twist of liquid crystal molecules of the liquid crystal layer is controlled by changing the voltage. Then, when white light of the backlight passing through the liquid crystal layer passes through the color filter of R, G or B in response to the twist of the liquid crystal molecules, it is converted into R, G or B light thereby to display an image.

It is to be noted that to change the voltage to control the twist of liquid crystal molecules to change the transmission factor of light is hereinafter referred to as control of the liquid crystal transmission factor. Further, the luminance of light emitted from the backlight as a light source is hereinafter referred to as "light emission luminance", and the luminance of light emitted from the front face of the liquid crystal panel which is the intensity of light felt by a viewer who looks at the image displayed on the liquid crystal display apparatus is hereinafter referred to as "display luminance".

In the past, for example, a cold cathode fluorescence discharge lamp (hereinafter referred to as CCFL) or a white LED (Light Emitting Diode) has been used as a light source of a backlight for a liquid crystal display apparatus. A liquid crystal display apparatus to which a CCFL or a white LED is applied as a light source of the backlight has a problem that the reproduction range of color represented by the area of a triangle formed from three apexes of R, G and B on an xy chromaticity diagram according to the CIE (Commission International de l'Eclairage) 1931 calorimetric system is smaller than that of a CRT (Cathode Ray Tube) display unit.

As a countermeasure against this problem, a liquid crystal display apparatus wherein R, G and B LEDs are adopted as the light source of the backlight to expand the reproduction range of color is disclosed, for example, in Japanese Patent No. 3766042 (hereinafter referred to as Patent Document 1).

In the liquid crystal display apparatus disclosed in Patent Document 1, the backlight includes a plurality of LED blocks, each of which is formed from R, G, and B LEDs. In each LED block, the current values of current to be supplied to the R, G and B LEDs are adjusted such that the color temperature becomes equal to a predetermined specific value which represents white light. Further, the current values of current to be supplied to the R, G and B LEDs of each LED block are adjusted such that all of the LED blocks have an equal and maximum light emission luminance. Consequently, light emission by an equal color temperature and maximum luminance is implemented over the overall area of the backlight.

However, the backlight of the liquid crystal display apparatus disclosed in Patent Document 1 has a problem that power consumption is high and the contrast ratio of the display luminance is low. This is because, since the overall screen of the liquid crystal panel is usually illuminated with uniform and maximum luminance, for example, also in a case wherein a dark image is displayed, the backlight emits light with the maximum light emission luminance.

Therefore, in order to reduce the power consumption, a method has been proposed wherein not the overall screen of the liquid crystal panel is usually illuminated with uniform and maximum luminance but a lighting region of the backlight is divided into a plurality of regions and the light emission luminance for each region is varied in response to the luminance distribution of an image. The method is disclosed, for example, in Japanese Patent Laid-Open No. 2004-212503 (hereinafter referred to as Patent Document 2) or in Japanese Patent Laid-Open No. 2004-246117 (hereinafter referred to as Patent Document 3).

SUMMARY OF THE INVENTION

However, there is the possibility that, for example, if the liquid crystal display apparatus disclosed in Patent Document 1 is applied to the method disclosed in Patent Document 2 or 3 such that the LED blocks of the backlight of Patent Document 1 individually correspond to divisional regions formed by dividing the lighting region and the light emission luminance of the LED blocks is varied in response to the luminance distribution of an image in the regions, that is, if control of the whiteness and control of the light emission luminance are performed with the current value, then such a situation that control of the current value is complicated and, depending upon the difference in characteristic among the LEDs, light of adjacent regions is mixed such that light of a color different from white is emitted may possibly occur.

Therefore, it is a desire to provide a backlight apparatus, a backlight controlling method and a liquid crystal display apparatus which allow light to be emitted from an overall area of a lighting region with equal whiteness while low power consumption is implemented.

According to an embodiment of the present invention, there is provided a backlight apparatus for controlling a backlight wherein light emitting devices for emitting light of red, green and blue and a switching device for switching on or off light emission of the light emitting devices are provided for each of a plurality of divisional regions formed by division of a lighting region such that the light emission luminance can be varied for each of the regions. The backlight apparatus includes a light emission luminance control section configured to vary the pulse width of a pulse signal to be supplied to the switching device in each of the regions to control the light emission luminance of the region, a current value storage section configured to store, for each of the regions, current values of current to be supplied to the red, green and blue light emitting devices, the current values being determined such that the whiteness and the light emission luminance of light from the red, green and blue light emitting devices become equal to a predetermined value, and a current control section configured to control the current values of current to be supplied to the red, green and blue light emitting devices in each of the regions so that the current values may become equal to the current values stored in the current value storage section.

The backlight apparatus may further include a current value determination section configured to determine the current values for each of the regions based on the whiteness and the light emission luminance of light from the red, green and blue light emitting devices.

According to another embodiment of the present invention, there is provided a backlight controlling method for performing a backlight controlling process of controlling a backlight wherein light emitting devices for emitting light of red, green and blue and a switching device for switching on or off light emission of the light emitting devices are provided for each of a plurality of divisional regions formed by division of a lighting region such that the light emission luminance can be varied for each of the regions. The backlight controlling method includes the steps of varying the pulse width of a pulse signal to be supplied to the switching device in each of the regions to control the light emission luminance of the region, and controlling the current values of current to be supplied to the red, green and blue light emitting devices in each of the regions so that the current values may become equal to current values with which the whiteness and the light emission luminance of light from the red, green and blue light emitting devices become equal to a predetermined value.

According to a further embodiment of the present invention, there is provided a liquid crystal display apparatus includes a backlight wherein light emitting devices for emitting light of red, green and blue and a switching device for switching on or off light emission of the light emitting devices are provided for each of a plurality of divisional regions formed by division of a lighting region such that the light emission luminance can be varied for each of the regions. The liquid crystal display apparatus further includes a light emission luminance control section configured to vary the pulse width of a pulse signal to be supplied to the switching device in each of the regions to control the light emission luminance of the region. The liquid crystal display apparatus further includes a current value storage section configured to store, for each of the regions, current values of current to be supplied to the red, green and blue light emitting devices, the current values being determined such that the whiteness and the light emission luminance of light from the red, green and blue light emitting devices become equal to a predetermined value. The liquid crystal display apparatus further includes a current control section configured to control the current values of current to be supplied to the red, green and blue light emitting devices in each of the regions so that the current values may become equal to the current values stored in the current value storage section.

In the backlight apparatus, backlight controlling method and liquid crystal display apparatus, the pulse width of the pulse signal to be supplied to the switching device is varied to control the light emission luminance of each of the divisional regions formed by division of the lighting region. Further, the current values of current to be supplied to the red, green and blue light emitting devices are controlled so that the whiteness and the light emission luminance of light from the red, green and blue light emitting devices may become predetermined values.

With the backlight apparatus, backlight controlling method and liquid crystal display apparatus, light can be emitted with equal whiteness from an overall area of the lighting region while low power consumption is implemented.

The above and other objects, features and advantages of the present invention will become apparent from the following description and the appended claims, taken in conjunction with the accompanying drawings in which like parts or elements denoted by like reference characters.

BRIEF DESCRIPTION OF THE DRAWINGS

FIG. 4 is a table showing an example of an LUT used in the LUT production process;

DETAILED DESCRIPTION OF THE PREFERRED EMBODIMENT

Figure 1:
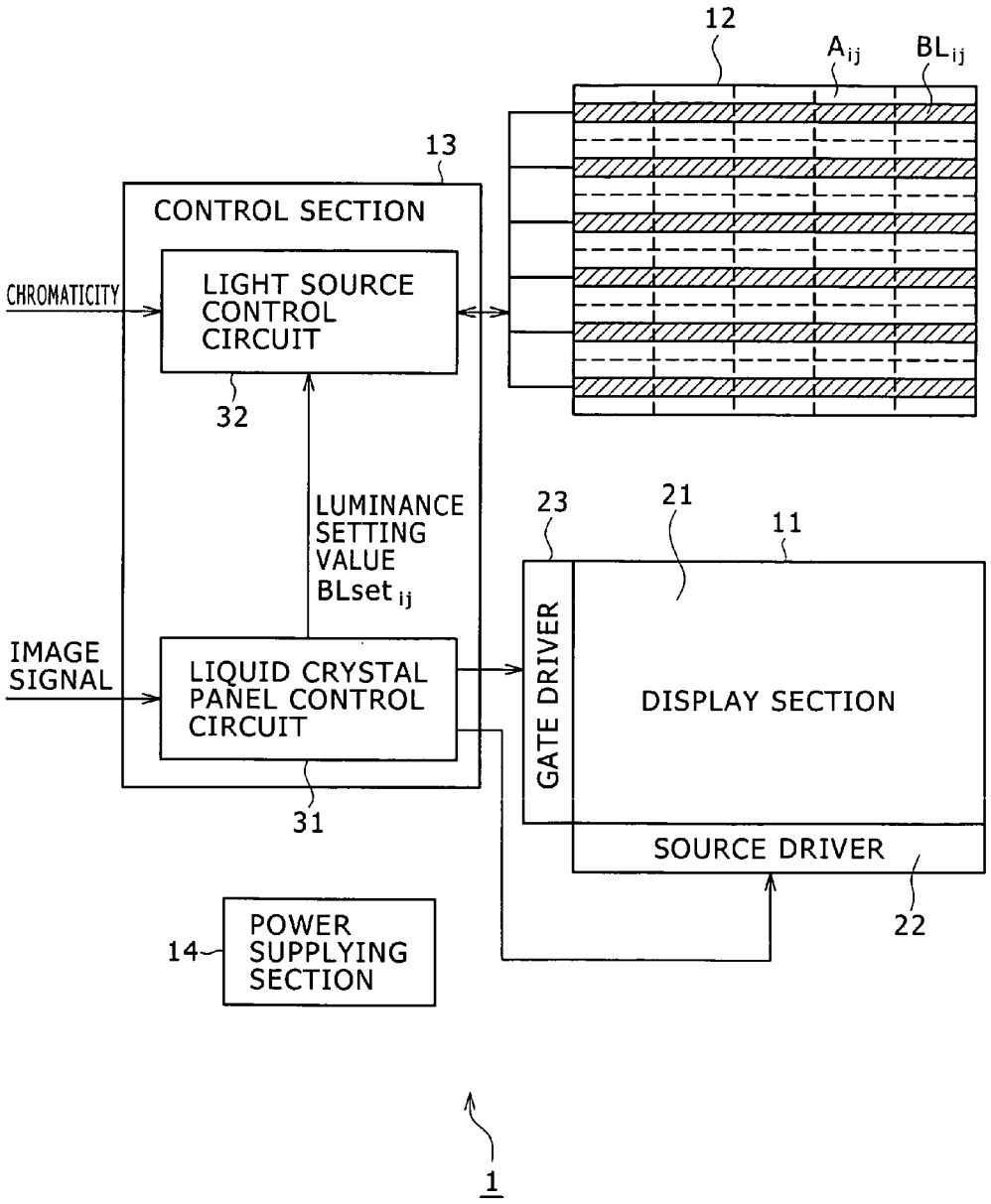
FIG. 1 is a block diagram showing an example of a configuration of a liquid crystal display apparatus to which the present invention is applied.

Before a preferred embodiment of the present invention is described in detail, a corresponding relationship between several features recited in the accompanying claims and particular elements of the preferred embodiment described below is described. The description, however, is merely for the confirmation that the particular elements which support the invention as recited in the claims are disclosed in the description of the embodiment of the present invention. Accordingly, even if some particular element which is recited in description of the embodiment is not recited as one of the features in the following description, this does not signify that the particular element does not correspond to the feature. On the contrary, even if some particular element is recited as an element corresponding to one of the features, this does not signify that the element does not correspond to any other feature than the element.

According to an embodiment of the present invention, there is provided a backlight apparatus (for example, a light source control circuit 32 of FIG. 1) for controlling a backlight (for example, a backlight 12 of FIG. 1) wherein light emitting devices (for example, LEDs 51R, 51G and 51B of FIG. 2) for emitting light of red, green and blue and a switching device (for example, a switching device 53 of FIG. 2) for switching on or off light emission of the light emitting devices are provided for each of a plurality of divisional regions formed by division of a lighting region such that the light emission luminance can be varied for each of the regions, the backlight apparatus comprising a light emission luminance control section (for example, a luminance control section 61 of FIG. 2) configured to vary the pulse width of a pulse signal to be supplied to the switching device in each of the regions to control the light emission luminance of the region, a current value storage section (for example, a memory 73 of FIG. 2) configured to store, for each of the regions, current values of current to be supplied to the red, green and blue light emitting devices, the current values being determined such that the whiteness and the light emission luminance of light from the red, green and blue light emitting devices become equal to a predetermined value, and a current control section (for example, a current control section 74 of FIG. 2) configured to control the current values of current to be supplied to the red, green and blue light emitting devices in each of the regions so that the current values may become equal to the current values stored in the current value storage section.

The backlight apparatus may further comprise a current value determination section (for example, a current value determination section 75 of FIG. 2) configured to determine the current values for each of the regions based on the whiteness and the light emission luminance of light from the red, green and blue light emitting devices.

Figures 5, 6:
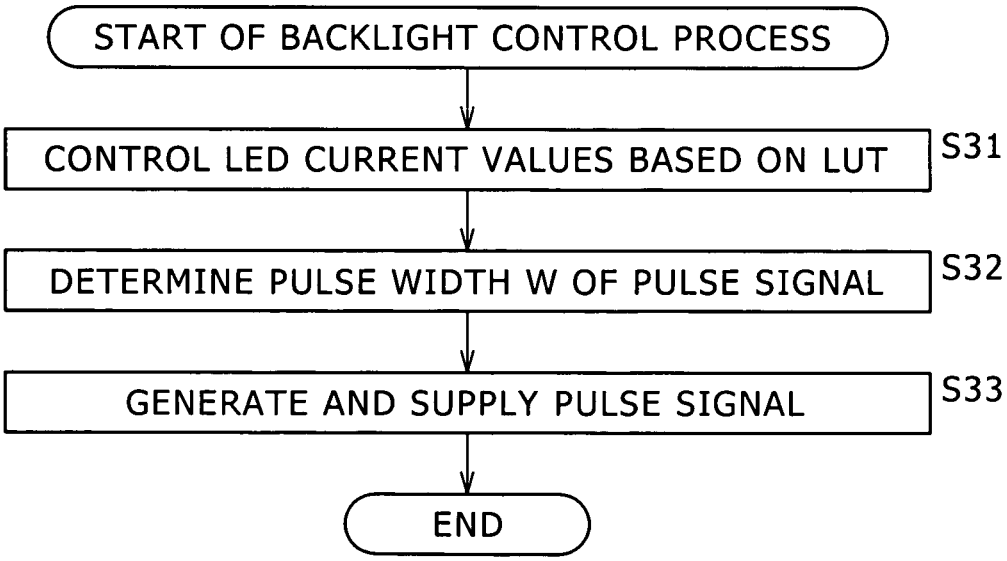
FIG. 5 is a table illustrating another example of the LUT used in the LUT production process.
FIG. 6 is a flow chart illustrating a backlight controlling process executed by the liquid crystal display apparatus.

According to another embodiment of the present invention, there is provided a backlight controlling method for performing a backlight controlling process of controlling a backlight wherein light emitting devices for emitting light of red, green and blue and a switching device for switching on or off light emission of the light emitting devices are provided for each of a plurality of divisional regions formed by division of a lighting region such that the light emission luminance can be varied for each of the regions, the backlight controlling method comprising the steps of varying the pulse width of a pulse signal to be supplied to the switching device in each of the regions to control the light emission luminance of the region (for example, steps S32 and S33 of FIG. 6), and controlling the current values of current to be supplied to the red, green and blue light emitting devices in each of the regions so that the current values may become equal to current values with which the whiteness and the light emission luminance of light from the red, green and blue light emitting devices become equal to a predetermined value (for example, a step S31 of FIG. 6).

In the following, an embodiment of the present invention is described with reference to the drawings.

FIG. 1 shows an example of a configuration of a liquid crystal display apparatus to which the present invention is applied.

Referring to FIG. 1, a liquid crystal display apparatus 1 according to the present embodiment includes a liquid crystal panel 11 which in turn includes a color filter substrate colored in red (R), green (G) and blue (B) and a liquid crystal layer, a backlight 12 disposed on the back face side of the liquid crystal panel 11. The liquid crystal display apparatus 1 further includes a control section 13 for controlling the liquid crystal panel 11 and the backlight 12, and a power supplying section 14 for supplying power to the components of the liquid crystal display apparatus 1.

The liquid crystal display apparatus 1 displays an original image corresponding to an inputted image signal in a predetermined display region (display section 21) thereof. It is to be noted that the image signal inputted to the liquid crystal display apparatus 1 corresponds, for example, to an image having a frame rate of 60 Hz (such an image is hereinafter referred to as field image).

The liquid crystal panel 11 includes a display section 21 on which a plurality of openings for passing light from the backlight 12 therethrough are arranged, and a source driver 22 and a gate driver 23 for signaling driving signals to transistors (TFTs: Thin Film Transistors) not shown provided at the openings of the display section 21.

It is to be noted that light having passed through each opening is converted into light of R, G or B by a color filter of R, G or B formed on the color filter substrate not shown. A combination of three openings through which light of R, G and B is emitted corresponds to one pixel of the display section 21, and each of the openings through which the R, G and B light is emitted has a role as a sub pixel which forms the pixel.

The backlight 12 emits white light in a predetermined lighting region thereof corresponding to the display section 21. The lighting region of the backlight 12 is divided into a plurality of regions, for each of which lighting is controlled.

In the present embodiment, the lighting region of the backlight 12 includes such divisional regions $A_{11}$ to $A_{56}$ wherein five regions are arranged in the horizontal direction and six regions are arranged in the vertical direction. The backlight 12 has light sources $BL_{11}$ to $BL_{56}$ corresponding to the regions $A_{11}$ to $A_{56}$, respectively.

The light source $BL_{ij}$ (i=1 to 5, j=1 to 6) disposed in the region $A_{ij}$ includes, for example, LEDs (Light Emitting Diodes) which are light emitting devices for emitting light of R, G and B and are arranged in a predetermined order. The light source $BL_{ij}$ emits white light obtained by mixture of R, G and B light based on a control signal supplied from a light source control circuit 32. The control signal supplied from the light source control circuit 32 is a pulse signal having a pulse width W.

It is to be noted that the regions $A_{11}$ to $A_{56}$ are formed not by physically dividing the lighting region of the backlight 12 using partition plates or the like but by virtually dividing the lighting region into regions individually corresponding to the light source $BL_{11}$ to $BL_{56}$-Accordingly, while light outputted from the light source $BL_{ij}$ is diffused by a diffuser not shown or the like so as to be irradiated not only on the region $A_{ij}$ corresponding to the light source $BL_{ij}$ but also on regions around the region $A_{ij}$, it is assumed that, in order to simplify the description, in the present embodiment, display luminance $Areq_{ij}$ necessary for the region $A_{ij}$ is obtained from the light source $BL_{ij}$.

The control section 13 includes a liquid crystal panel control circuit 31 for controlling the liquid crystal panel 11, and the light source control circuit 32 for controlling the backlight 12.

To the liquid crystal panel control circuit 31, an image signal corresponding to a field image is supplied from a different apparatus. The liquid crystal panel control circuit 31 determines a luminance distribution of the field image from the image signal supplied thereto. Then, the liquid crystal panel control circuit 31 calculates the display luminance $Areq_{ij}$ necessary for each region $A_{ij}$ from the luminance distribution of the field image.

Further, the liquid crystal panel control circuit 31 calculates a luminance setting value $BLset_{ij}$ for setting the light emission luminance of the light source $BL_{ij}$ and a setting gradation S_data which is a value of eight bits for determining the liquid crystal transmission factor of the pixel from the display luminance $Areq_{ij}$ necessary for the region $A_{ij}$. The setting gradation S_data is supplied as a driving control signal to the source driver 22 and the gate driver 23 of the liquid crystal panel 11 while the luminance setting value $BLset_{ij}$ is supplied to the light source control circuit 32.

The light source control circuit 32 sets the pulse width W based on the luminance setting value $BLset_{ij}$ supplied thereto from the liquid crystal panel control circuit 31 and supplies a pulse signal having the pulse width W to the backlight 12. Consequently, the light source $BL_{ij}$ disposed in the region $A_{ij}$ of the backlight 12 emits light with light emission luminance corresponding to the luminance setting value $BLset_{ij}$.

Further, the light source control circuit 32 stores the decided current value for each of the LEDs of R, G and B which form each light source $BL_{ij}$ so that all of the light sources $BL_{11}$ to $BL_{56}$ have an equal whiteness (color temperature) and equal light emission luminance. Further, the light source control circuit 32 controls the value of current to be supplied from the power supplying section 14 to the backlight 12 so that the whiteness and light emission luminance correspond to the current value.

It is to be noted that the light source control circuit 32 forms a backlight apparatus together with the backlight 12.

The power supplying section 14 supplies power to the liquid crystal panel 11, backlight 12 and control section 12.

Figure 2:
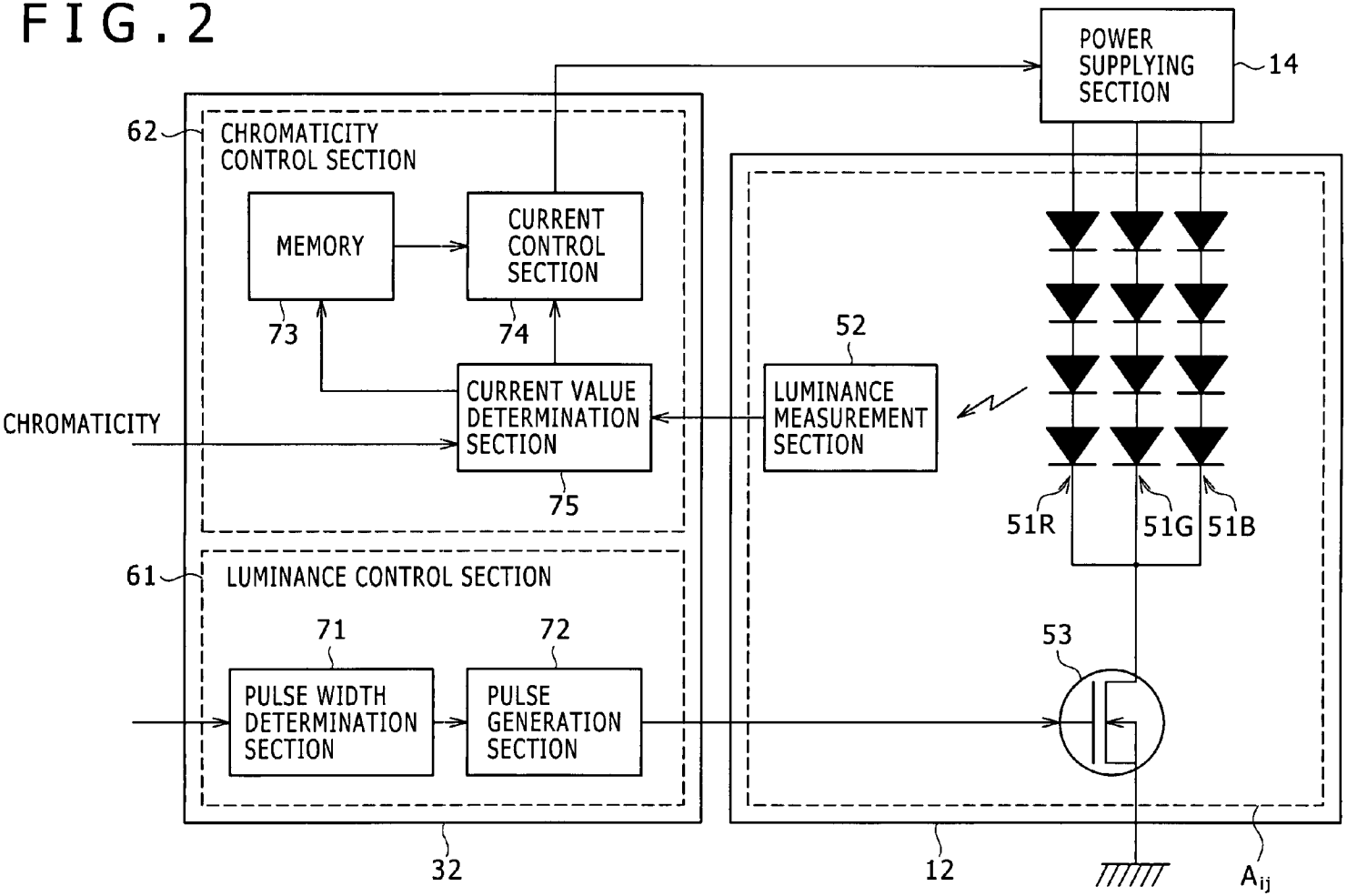
FIG. 2 is a block diagram showing an example of a detailed configuration of a backlight and a light source control circuit of the liquid crystal display apparatus.

FIG. 2 is a functional block diagram showing a detailed configuration of the backlight 12 and the light source control circuit 32.

Referring to FIG. 2, in the region $A_{ij}$ of the backlight 12, LEDs 51R which emit light of R, LEDs 51G which emit light of G, LEDs 51B which emit light of B, a luminance measurement section 52 for measuring the light emission luminance and a switching device 53 are provided.

The light source control circuit 32 includes a luminance control section 61 and a chromaticity control section 62. The luminance control section 61 includes a pulse width determination section 71 and a pulse generation section 72, and performs PWM (Pulse Width Modulation) control to control the light emission luminance individually of the regions $A_{11}$ to $A_{56}$. The chromaticity control section 62 includes a memory 73, a current control section 74 and a current value determination section 75, and performs PAM (Pulse Amplitude Modulation) control to control the chromaticity of light to be emitted individually from the regions $A_{11}$ to $A_{56}$.

The region $A_{ij}$ includes a plurality of sets of an LED 51R for R, another LED 51G for G and a further LED 51B for B, and the power supplying section 14 can supply signals having current values different from each other individually to the LEDs 51R, 51G and 51B.

The luminance measurement section 52 includes, for example, a photodiode. The luminance measurement section 52 measures the light emission luminance of white light formed by mixture of light of red, green and blue and supplies a result of the measurement to the current value determination section 75. The switching device 53 is formed, for example, from an FET (Field Effect Transistor), and, if a signal having a predetermined level is supplied from the pulse generation section 72, then the switching device 53 functions as a switch for applying current to the LEDs 51R, 51G and 51B. The LEDs 51R, 51G and 51B emit light with a luminance corresponding to the value of current supplied thereto.

It is to be noted that, for one region $A_{ij}$ of the backlight 12, a switching device 53 may be provided for each of the LEDs 51R, 51G and 51B or a plurality of the switching devices 53 may be provided for each of the LEDs 51R, 51G and 51B. Further, the luminance measurement section 52 may perform measurement at a predetermined one point in the region $A_{ij}$ or at a plurality of points in the region $A_{ij}$. Therefore, the number of the LEDs 51R, 51G and 51B, luminance measurement sections 52, and switching devices 53 to be disposed in the region $A_{ij}$ is not limited specially.

The luminance setting value $BLset_{ij}$ supplied from the liquid crystal panel control circuit 31 is supplied to the pulse width determination section 71 of the luminance control section 61. The pulse width determination section 71 determines the pulse width W of the pulse signal to be supplied to the switching device 53 in the region $A_{ij}$ in response to the luminance setting value $BLset_{ij}$ supplied thereto from the liquid crystal panel control circuit 31. Here, the pulse width W represents the width of a high-level (High level) interval of the pulse signal. The pulse generation section 72 generates a pulse signal having the pulse width W determined by the pulse width determination section 71 and supplies the pulse signal to the switching device 53 in the region $A_{ij}$.

The memory 73 stores an LUT (Look Up Table) wherein the regions $A_{11}$ to $A_{56}$ and current values supplied to the LEDs 51R, 51G and 51B of the regions are associated with each other. Each of the current values stored in the LUT is a value with which light obtained by mixture of light of R, G and B when the LEDs 51R, 51G and 51B in the region A emit light of the corresponding colors has an equal whiteness and equal light emission luminance in the regions $A_{11}$ to $A_{56}$.

The current control section 74 controls the values of current to be supplied from the power supplying section 14 to the LEDs 51R, 51G and 51B of the region $A_{ij}$ based on the current values stored in the memory 73. In particular, the current control section 74 controls the power supplying section 14 so that the values of current to be supplied to the LEDs 51R, 51G and 51B of the region $A_{ij}$ become equal to the corresponding current values stored in the LUT of the memory 73. Further, the current control section 74 can control also the power supplying section 14 so that the values of current to be supplied to the LEDs 51R, 51G and 51B of the region $A_{ij}$ become equal to current values designated by the current value determination section 75.

The current value determination section 75 determines the current values of current to be supplied from the power supplying section 14 to the LEDs 51R, 51G and 51B of the regions $A_{ij}$ so that the regions $A_{11}$ to $A_{56}$ have an equal whiteness and equal light emission luminance. It is to be noted that the value of current to be supplied to each of the LEDs 51R, 51G and 51B is hereinafter referred to sometimes as LED current value.

In particular, the current value determination section 75 designates the current values to the current control section 74 such that it acquires the chromaticity and light emission luminance when the LEDs 51R, 51G and 51B emit light with the designated current values. The chromaticity when the LEDs 51R, 51G and 51B emit light is measured by a different apparatus such as a chronoscope and is supplied to the current value determination section 75. On the other hand, the light emission luminance when the LEDs 51R, 51G and 51B emit light is supplied to the luminance measurement section 52. The current value determination section 75 varies the LED current values into various values and confirms the chromaticity corresponding to the varied values to determine LED-current values $IR_{ij}$, $IG_{ij}$ and $IB_{ij}$ with which the chromaticity becomes equal to a predetermined whiteness (hereinafter referred to as reference whiteness). By executing the process just described for all of the regions $A_{11}$ to $A_{56}$, the whiteness values of light to be emitted in the regions $A_{11}$ to $A_{56}$ become equal to each other.

However, the light emission luminances in the regions $A_{11}$ to $A_{56}$ are not equal to each other as yet. Therefore, the current value determination section 75 subsequently selects a predetermined region from among the regions $A_{11}$ to $A_{56}$, for example, a region having the highest light emission luminance from among the regions $A_{11}$ to $A_{56}$, as a reference region. Then, the current value determination section 75 calculates the coefficient $K_{ij}$ for adjusting the light emission luminance of the other regions to the light emission luminance of the reference region.

In particular, the current value determination section 75 increases the determined LED current values $IR_{ij}$, $IG_{ij}$ and $IB_{ij}$ by a predetermined magnification $K_{ij}$ to determine the values of current to be supplied to the LEDs 51R, 51G and 51B thereby to determine the LED current values $I'_{Rij}$, $I'_{Gij}$ and $I'_{Bij}$ with which the light emission luminance of the region $A_{ij}$ supplied from the luminance measurement section 52 becomes equal to that in the reference region.

Accordingly, the values of current to be supplied to the LEDs 51R, 51G and 51B in the region $A_{ij}$ with which the whiteness and the light emission luminance become equal in all of the regions $A_{11}$ to $A_{56}$ of the backlight 12 can be represented by $I'_{Rij}=I_{Rij}\times K_{ij}$, $I'_{Gij}=I_{Gij}\times K_{ij}$, and $I'_{Bij}=I_{Bij}\times K_{ij}$, respectively. It is to be noted that the coefficient $K_{ij}$ of the reference region is 1.

The current value determination section 75 stores the LED current values $I'_{Rij}=I_{Rij}\times K_{ij}$, $I'_{Gij}=I_{Gij}\times K_{ij}$, and $I'_{Bij}=I_{Bij}\times K_{ij}$ determined in such a manner as described above with which the whiteness and the light emission luminance become equal in the regions $A_{11}$ to $A_{56}$ as the LUT into the memory 73.

An LUT production process for producing an LUT to be stored into the memory 73 is described with reference to a flow chart of FIG. 3. The process is executed, for example, as an initialization process upon fabrication of the liquid crystal display apparatus 1.

Figure 3:
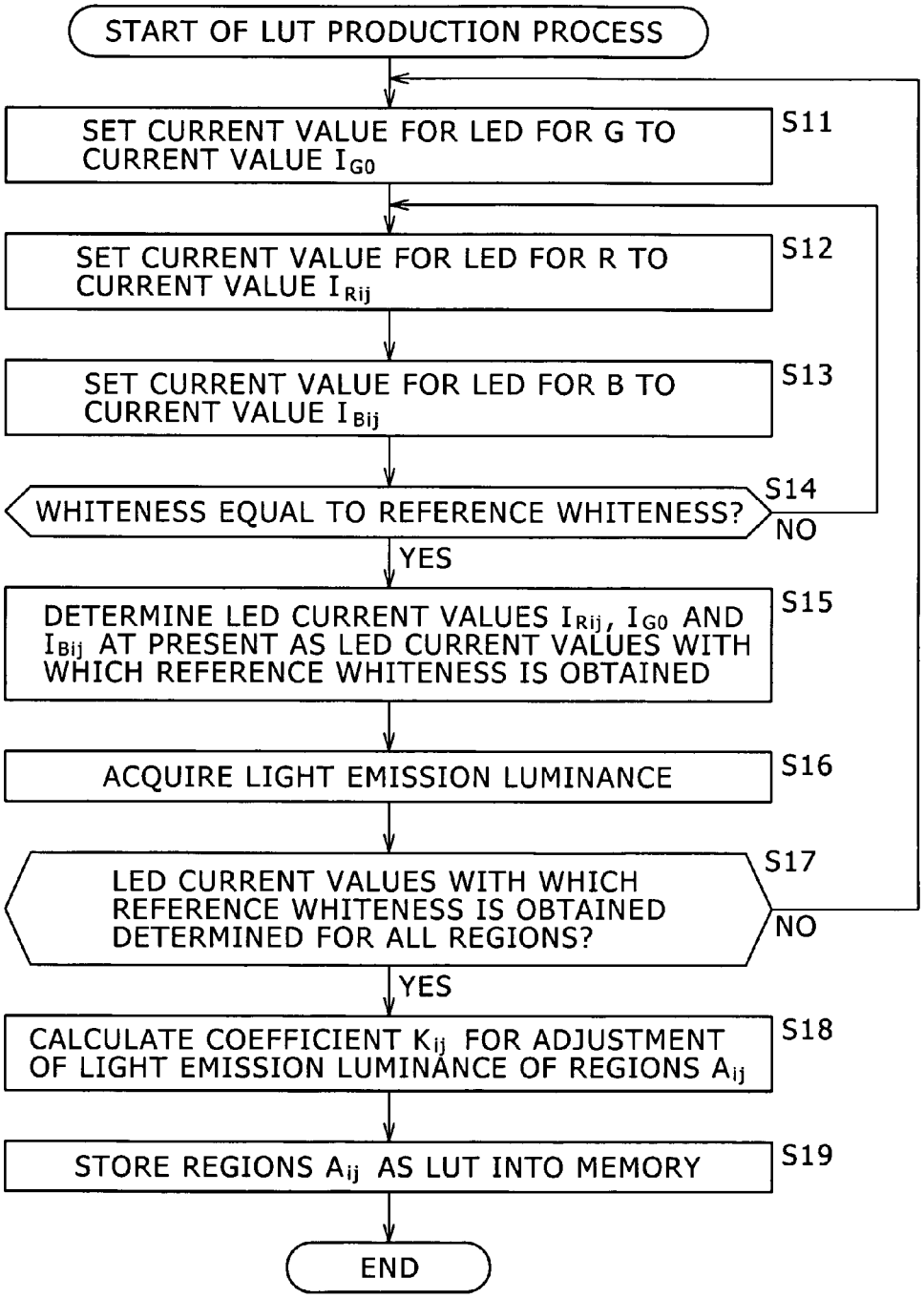
FIG. 3 is a flow chart illustrating an LUT production process executed by the liquid crystal display apparatus.

Referring to FIG. 3, first at step S11, the pulse width determination section 71 supplies a pulse width W decided in advance as the pulse width upon chromaticity adjustment to the pulse generation section 72. The pulse generation section 72 generates a pulse signal having the pulse width W supplied thereto from the pulse width determination section 71 and supplies the pulse signal to the switching device 53 of the region $A_{ij}$.

Further, at step S11, the chromaticity control section 62 sets the current value corresponding to the LED 51G for G in the predetermined region $A_{ij}$ from among the regions $A_{11}$ to $A_{56}$ to a predetermined value $I_{G0}$. In particular, the current value determination section 75 designates the current value $I_{G0}$ as the LED current value to be supplied to the LED 51G of the region $A_{ij}$ to the current control section 74. The current control section 74 controls the power supplying section 14 so that the LED current value to be supplied to the LED 51G of the region A becomes equal to the current value $I_{G0}$.

At step S12, the chromaticity control section 62 sets the value of current to be supplied to the LED 51R for R in the region $A_{ij}$ to a predetermined value $IR_{ij}$. In particular, the current value determination section 75 designates the current value $IR_{ij}$ as the LED current value to be supplied to the LED 51R of the region $A_{ij}$ to the current control section 74. Then, the current control section 74 controls the power supplying section 14 so that the value of LED current to be supplied to the LED 51R of the region A becomes equal to the current value $IR_{ij}$.

At step S13, the chromaticity control section 62 sets the value of current to be supplied to the LED 51B for B in the region $A_{ij}$ to a predetermined value $IB_{ij}$. In particular, the current value determination section 75 designates the current value $IB_{ij}$ as the LED current value to be supplied to the LED 51B of the region $A_{ij}$ to the current control section 74. The current control section 74 controls the power supplying section 14 so that the LED current value of current to be supplied to the LED 51B of the region A becomes equal to the current value $IB_{ij}$.

At step S14, the current value determination section 75 decides whether or not the whiteness of light from the LEDs 51R, 51G and 51B of the region $A_{ij}$ is equal to the reference whiteness.

In the memory 73, numerical values which indicate the reference whiteness which is a target value for making the whiteness of light from the LEDs 51R, 51G and 51B equal over the overall region of the backlight 12 are stored as (x, y) coordinates of an xy chromaticity diagram, for example, according to the CIE1931 colorimetric system. The current value determination section 75 compares a chromaticity value acquired from the different apparatus and the reference whiteness stored in the memory 73 with each other to decide whether or not the whiteness of light from the LEDs 51R, 51G and 51B of the region $A_{ij}$ is equal to the reference whiteness stored in the memory 73. It is to be noted that the current value determination section 75 decides, when the error between the chromaticity (whiteness) measured by the different apparatus and supplied thereto and the reference whiteness is within a predetermined allowance E, that the whiteness of light from the LEDs 51R, 51G and 51B of the region $A_{ij}$ is equal to the reference whiteness stored in the memory 73.

If it is decided at step S14 that the whiteness of light from the LEDs 51R, 51G and 51B of the region $A_{ij}$ is not equal to the reference whiteness, then the processing returns to step S12 to execute the processing at steps S12 to S14 again. In particular, the LED current values $IR_{ij}$ and $IB_{ij}$ to be supplied to the LEDs 51R and 51B are set to values different from those used till then, and it is decided again whether or not the whiteness of light from the LEDs 51R, 51G and 51B of the region $A_{ij}$ is equal to the reference whiteness.

On the other hand, if it is decided that at step S14 that the whiteness of light from the LEDs 51R, 51G and 51B of the region $A_{ij}$ is equal to the reference whiteness, then the current value determination section 75 determines, at step S15, the current LED current values $IR_{ij}$, $I_{G0}$ and $IB_{ij}$ as LED current values with which the reference whiteness is obtained.

At step S16, the current value determination section 75 acquires the light emission luminance of the region $A_{ij}$ supplied thereto from the luminance measurement section 52. The light emission luminance acquired here is the luminance when the LEDs 51R, 51G and 51B of the region $A_{ij}$ emit light in accordance with the reference whiteness.

At step S17, the current value determination section 75 decides whether or not the LED current values with which the reference whiteness is obtained are determined for all of the regions of the backlight 12.

If it is decided at step S17 that the LED current values with which the reference whiteness is obtained are not determined for all of the regions of the backlight 12, then the processing returns to step S11 to execute the processing at steps S11 to S17 for a region $A_{ij}$ with regard to which the LED current values with which the reference whiteness is obtained are not determined as yet. In particular, the LED current values $IR_{ij}$, $I_{G0}$ and $IB_{ij}$ of the region $A_{ij}$ with regard to which the LED current values with which the reference whiteness is obtained are not determined are determined.

On the other hand, if it is decided at step S17 that the LED current values with which the reference whiteness is obtained are determined for all of the regions of the backlight 12, then the current value determination section 75 calculates, at step S18, the coefficient $K_{ij}$ for adjusting the light emission luminance of each of the regions $A_{ij}$ of the backlight 12. In particular, the current value determination section 75 determines a predetermined region, for example, a region having the highest light emission luminance, from among the regions $A_{11}$ to $A_{56}$ as the reference region. Then, the current value determination section 75 determines the coefficient $K_{ij}$ by repetitively executing the process of designating the LED current values $I'_{Rij}$, $I'_{G0}$ and $I'_{Bij}$ calculated by multiplying the LED current values $IR_{ij}$, $I_{G0}$ and $I_{Bij}$ of the region $A_{ij}$ with which the reference whiteness is obtained by a predetermined multiplying factor $K_{ij}$ to the current control section 74 and acquiring the light emission luminance when the LEDs 51R, 51G and 51B emit light in accordance with the LED current values $I'_{Rij}$, $I'_{G0}$ and $I'_{Bij}$ from the luminance measurement section 52 of the region $A_{ij}$ until the light emission luminance of the region $A_{ij}$ acquired from the luminance measurement section 52 becomes equal to the light emission luminance of the reference region.

At step S19, the current value determination section 75 stores the LED current values $I'_{Rij}=I_{Rij}\times K_{ij}$, $I'_{Gij}=I_{G0}\times K_{ij}$ and $I'_{Bij}=I_{Bij}\times K_{ij}$ of the regions $A_{ij}$ with which an equal whiteness and an equal light emission luminance are obtained in the regions $A_{11}$ to $A_{56}$ as the LUT into the memory 73. Then, the processing is ended.

In summary, the chromaticity control section 62 fixes the LED current value of current to be supplied to the LED 51G to a current value $I_{G0}$ and varies the LED current values $IR_{ij}$ and $IB_{ij}$ of current to be supplied to the other LEDs 51R and 51B to determine a combination of the LED current values $IR_{ij}$, $I_{G0}$ and $IB_{ij}$ with which the whiteness of light from the LEDs 51R, 51G and 51B of the region $A_{ij}$ becomes equal to the reference whiteness.

Then, the chromaticity control section 62 selects, for example, a region which exhibits the highest light emission luminance from among the regions $A_{11}$ to $A_{56}$ as a reference region and determines a coefficient $K_{ij}$ to be used for adjustment to the light emission luminance of the reference region. Then, the chromaticity control section 62 stores LED current values $I'_{Rij}=I_{Rij}\times K_{ij}$, $I'_{Gij}=I_{G0}\times K_{ij}$ and $I'_{Bij}=I_{Bij}\times K_{ij}$ for the regions $A_{ij}$ with which an equal whiteness and an equal light emission luminance are finally obtained as the LUT into the memory 73.

FIG. 4 illustrates an example of the LUT stored in the memory 73 after the LUT production process.

In the memory 73, the regions $A_{ij}$ of the backlight 12 and the LED current values $I'_{Rij}=I_{Rij}\times K_{ij}$, $I'_{Gij}=I_{G0}\times K_{ij}$ and $I'_{Bij}=I_{Bij}\times K_{ij}$ for the regions $A_{ij}$ to be supplied to the LEDs 51R, 51G and 51B disposed in the regions $A_{ij}$ are stored in an associated relationship with each other, respectively.

It is to be noted that the LED current values $I'_{Rij}=I_{Rij}\times K_{ij}$, $I'_{Gij}=I_{G0}\times K_{ij}$ and $I'B_{ij}=I_{Bij}\times K_{ij}$ after the multiplication by the coefficients $K_{ij}$ may not be associated with the regions $A_{ij}$ of the backlight 12, but the LED current values $I_{Rij}$, $I_{G0}$ and $I_{Bij}$ for standardizing the chromaticity and the coefficients $K_{ij}$ for standardizing the light emission luminance may be stored separately in an associated relationship with the regions $A_{ij}$ as seen in FIG. 5. FIG. 5 illustrates an example where the reference region is the region $A_{12}$ (the coefficient $K_{12}$ is one).

Now, a backlight control process of the light source control circuit 32 where an image is displayed in response to an inputted image signal is described with reference to a flow chart of FIG. 6.

First at step S31, the current control section 74 controls the values LED current values of current to be supplied to the LEDs 51R, 51G and 51B in the regions $A_{ij}$ of the backlight 12 based on the LUT of the memory 73. In particular, the current control section 74 controls the power supplying section 14 so that the current values of current to be supplied to the LEDs 51R, 51G and 51B of the regions $A_{ij}$ may become individually equal to the respective current values stored in the LUT of the memory 73.

At step S32, the pulse width determination section 71 determines of the pulse width W of a pulse signal to be supplied to the switching device 53 of each region $A_{ij}$ in response to the luminance setting value $BLset_{ij}$ supplied thereto from the liquid crystal panel control circuit 31.

Then at step S33, the pulse generation section 72 generates a pulse signal of the pulse width W determined by the pulse width determination section 71 for each region A to the switching device 53 of the region $A_{ij}$. Then, the processing is ended.

The backlight controlling process described above is executed repetitively while an image signal is supplied to the liquid crystal panel control circuit 31 and a luminance setting value $BLset_{ij}$ corresponding to the image signal is supplied from the liquid crystal panel control circuit 31 to the light source control circuit 32.

Figure 7:
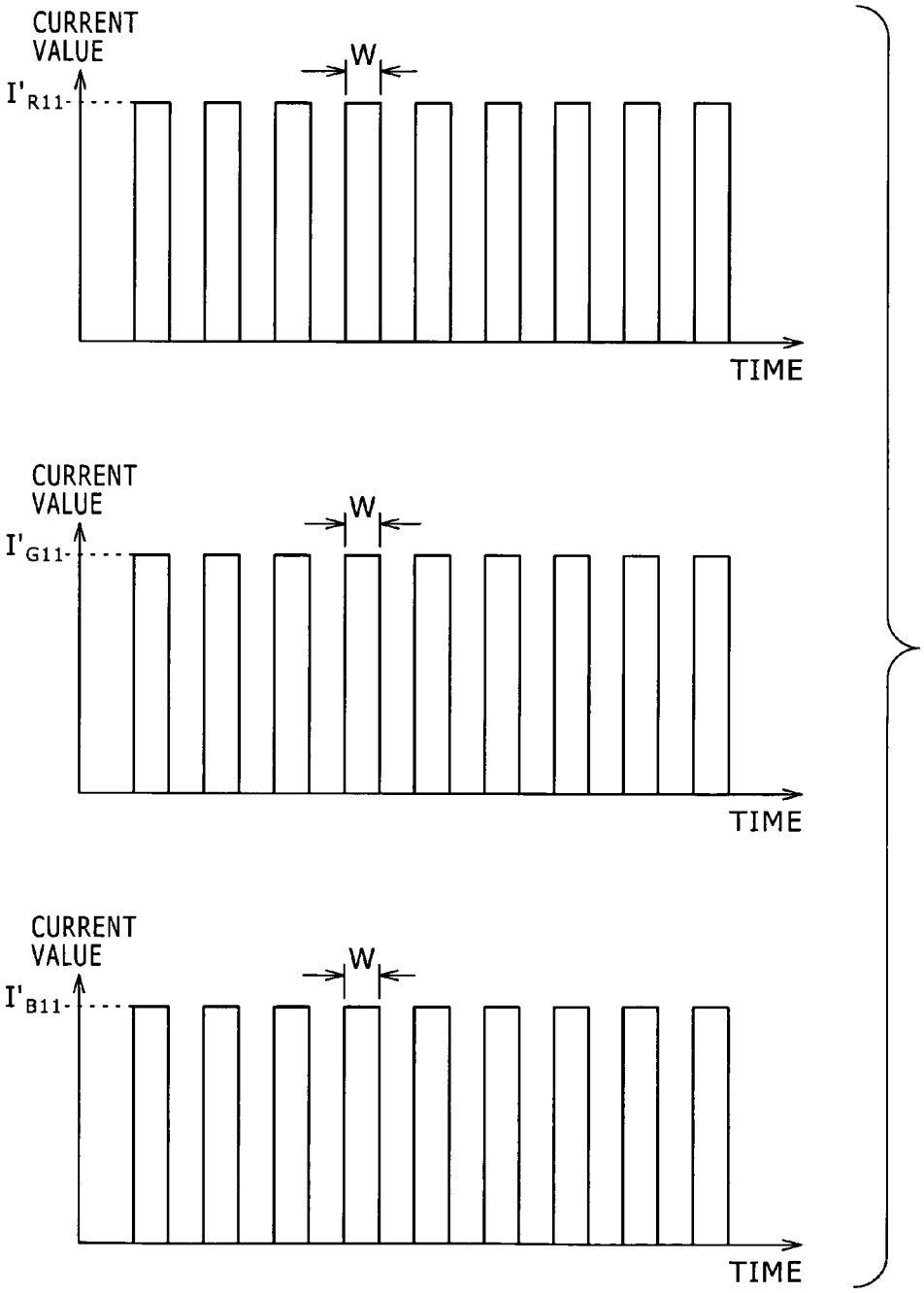
FIG. 7 is a diagram illustrating an example of current values applied to LEDs in the liquid crystal display apparatus.

Accordingly, in the region $A_{ij}$ of the backlight 12, when current of the current values $I'_{Rij}$, $I'_{Gij}$ and $I'_{Bij}$ is supplied to the LEDs 51R, 51G and 51B as seen in FIG. 7, respectively, the LEDs 51R, 51G and 51B emit light of the colors of R, G and B, respectively. Thereupon, the light is mixed to form light of the reference whiteness. The current values $I'_{Rij}$, $I'_{Gij}$ and $I'_{Bij}$ are not necessarily equal due to the difference in characteristic of the LEDs, but generally are different. On the other hand, the pulse width W which is one period within which current of the current values $I'_{Rij}$, $I'_{Gij}$ and $I'_{Bij}$ flow is equal among the LEDs 51R, 51G and 51B.

In particular, in the liquid crystal display apparatus 1, adjustment for making the whiteness and the light emission luminance equal among all of the light sources $BL_{11}$ to $BL_{56}$ is performed by adjusting the current values of current to be supplied to the LEDs 51R, 51G and 51B which form the light sources $BL_{ij}$, but adjustment of the light emission luminance (brightness) corresponding to the luminance setting values $BLset_{ij}$ obtained from the image signal is performed by varying the duty ratio of the pulse signal.

Accordingly, since the pulse widths W of the pulse signals to be supplied to the LEDs 51R, 51G and 51B of each region $A_{ij}$ can be made equal, the control (circuit) can be simplified. Further, the luminance setting value $BLset_{ij}$ based on which the pulse width W is to be determined is determined display luminance $Areq_{ij}$ calculated from the inputted image signal and necessary for the region $A_{ij}$. Therefore, when compared with an alternative case wherein such divisional driving of the backlight 12 as described above is not used, it is possible to suppress unnecessary light emission luminance thereby to reduce power consumption and raise the contrast ratio of the display luminance.

Further, since the current values of current to be supplied to the LEDs 51R, 51G and 51B of each region $A_{ij}$ are adjusted so that all of the light sources $BL_{11}$ to $BL_{56}$ emit light of an equal whiteness and equal light emission luminance, for example, such a situation that the emitted light colors of adjacent regions mix with each other, by which the chromaticity becomes difference from the reference whiteness.

It is to be noted that, in the LUT production process described hereinabove with reference to FIG. 3, the LED current value of current to be supplied to the LED 51G is fixed to the current value $I_{G0}$ while the LED current values $I_{Rij}$ and $I_{Bij}$ of current to be supplied to the other LEDs 51R and 51B are varied to various values to determine the LED current values $I_{Rij}$, $I_{G0}$ and $I_{Bij}$ with which the whiteness of light from the LEDs 51R, 51G and 51B of the region A becomes equal to the reference whiteness. However, alternatively the LED current value of current to be supplied to the other LED 51R or 51B than the LED 51G may be fixed while the other current values are varied to various values to determine a combination of LED current values with which the reference whiteness is obtained. Naturally, a combination of LED current values with which the reference whiteness is obtained may be determined while all of the LED current values of current to be supplied to the LEDs 51G, 51R and 51B are varied.

Figure 8:
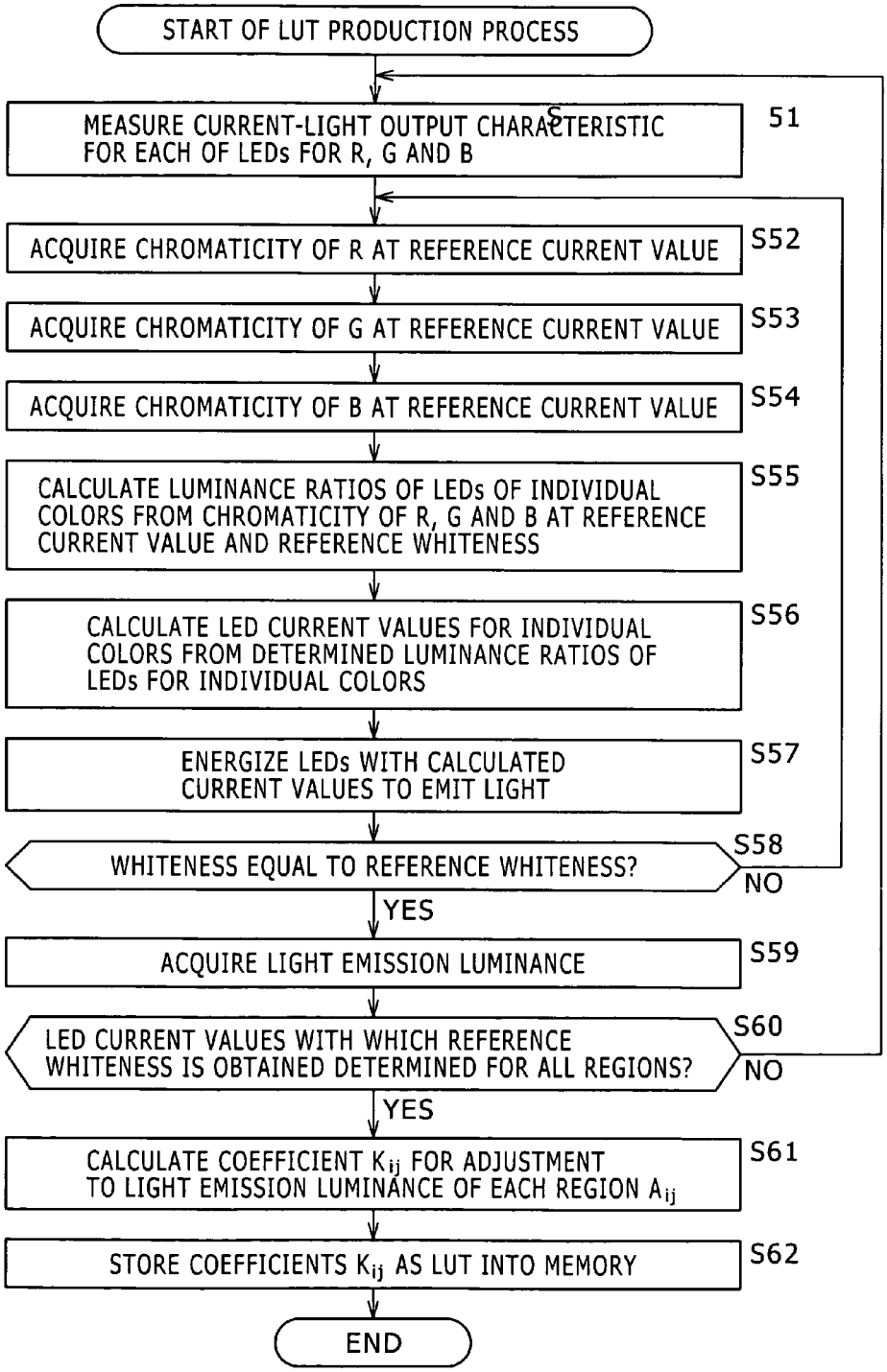
FIGS. 8 and 9 are flow charts illustrating different LUT production processes executed by the liquid crystal display apparatus.

Or, a combination of LED current values with which the reference whiteness is obtained may be determined by an LUT production process illustrated in a flow chart of FIG. 8. In particular, FIG. 8 illustrates a flow chart of another LUT production process executed by the light source control circuit 32.

Referring to FIG. 8, first at step S51, the pulse width determination section 71 supplies a pulse width W determined in advance as a pulse width for chromaticity adjustment. Further, the pulse generation section 72 generates a pulse signal of the pulse width W supplied from the pulse width determination section 71 and supplies the pulse signal to the switching device 53 of the region $A_{ij}$.

Further, at step S51, the chromaticity control section 62 measures the current-light output characteristic for each of the LEDs 51R, 51G and 51B for R, G and B. In particular, the chromaticity control section 62 sets the current values of current to be supplied to the LEDs 51G and 51B to zero while it varies the LED current value of current to be supplied to the LED 51R from its minimum value (zero) to its maximum value to acquire the light emission luminance of the region $A_{ij}$ at the individual LED current values from the luminance measurement section 52 to measure the current-light output characteristic of the LED 51R disposed in the region $A_{ij}$. Further, the chromaticity control section 62 performs similar operation also for the LEDS 51G and 51B.

At step S52, the current value determination section 75 determines a predetermined value within a range of the current value within which the current value and the light output (light emission luminance) have a proportional relationship from the current-light output characteristics of the LEDs 51R, 51G and 51B as a reference current value.

Further, at step S52, the chromaticity control section 62 acquires the chromaticity of R at the reference current value. In particular, the current value determination section 75 designates the reference current value as an LED current value to be supplied to the LED 51R of the region $A_{ij}$ to the current control section 74. Then, the current control section 74 controls the power supplying section 14 so that the LED current value of current to be supplied to the LED 51R may become equal to the reference current value. No current flows to the LEDs 51G and 51B of the region $A_{ij}$. At this time, the LED 51R of the region A emits light with the reference current value, and the chromaticity at this time is supplied from the different apparatus to the current value determination section 75.

At step S53, the chromaticity control section 62 acquires the chromaticity of G at the reference current value. In particular, the current value determination section 75 designates the reference current value as the LED current value of current to be supplied to the LED 51G of the region $A_{ij}$ to the current control section 74. Thus, the current control section 74 controls the power supplying section 14 so that the LED current value of current to be supplied to the LED 51G may become equal to the reference current value. No current flows to the LEDs 51R and 51B of the region $A_{ij}$. At this time, the LED 51G of the region A emits light with the reference current value, and the whiteness at this time is supplied from the different apparatus to the current value determination section 75.

At step S54, the chromaticity control section 62 acquires the chromaticity of B at the reference current value. In particular, the current value determination section 75 designates the reference current value as the LED current value of current to be supplied to the LED 51B of the region $A_{ij}$ to the current control section 74. Thus, the current control section 74 controls the power supplying section 14 so that the LED current value of current to be supplied to the LED 51B may become equal to the reference current value. No current flows to the LED 51R and 52G of the region $A_{ij}$. At this time, the LED 51B of the region A emits light with the reference current value, and the whiteness at this time is supplied from the different apparatus to the current value determination section 75.

At step S55, the current value determination section 75 calculates the luminance ratios (luminance rates) of the LEDs of the colors of the region $A_{ij}$, that is, of the LEDs 51R, 51G and 51B, from the chromaticity of R, G and B at the reference current value and the reference whiteness. Since an arbitrary color can be made isometrically of three colors independent of each other in the Grassmann's first law, the luminance ratio of each of R, G and B with which the reference whiteness is obtained can be determined.

At step S56, the current value determination section 75 calculates the LED current values $I_{Rij}$, $I_{Gij}$ and $I_{Bij}$ of the colors from the calculated luminance ratios of the LEDs of the colors. Here, the current-light output characteristics of the LEDs 51R, 51G and 51B measured at step S51 are referred to calculate the LED current values $I_{Rij}$, $I_{Gij}$ and $I_{Bij}$.

At step S57, the chromaticity control section 62 causes the LEDs 51R, 51G and 51B in the region $A_{ij}$ to emit light with the calculated current values $I_{Rij}$, $I_{Gij}$ and $I_{Bij}$. In particular, the current value determination section 75 designates the LED current value $I_{Rij}$ as the LED current value of current to be supplied to the LED 51R of the region $A_{ij}$. Then, the current control section 74 controls the power supplying section 14 so that the LED current value to be supplied to the LED 51R may become equal to the LED current value $I_{Rij}$. Also the LEDs 51G and 51B in the region $A_{ij}$ are controlled similarly.

At step S58, the current value determination section 75 decides whether or not the whiteness of light from the LEDs 51R, 51G and 51B is equal to the reference whiteness.

If it is decided at step S58 that the whiteness of light from the LEDs 51R, 51G and 51B is not equal to the reference whiteness, then the processing returns to step S51 so that the processing at steps S51 to S58 is executed again.

On the other hand, if it is decided at step S58 that the whiteness of light from the LEDs 51R, 51G and 51B is equal to the reference whiteness, then the processing advances to step S59.

Processes at steps S59 to S62 are similar to those at steps S16 to S19 described hereinabove with reference to FIG. 3, and therefore, overlapping description of them is omitted herein to avoid redundancy.

A combination of LED current values with which the reference whiteness is obtained can be determined in such a manner as described above.

Figure 9:
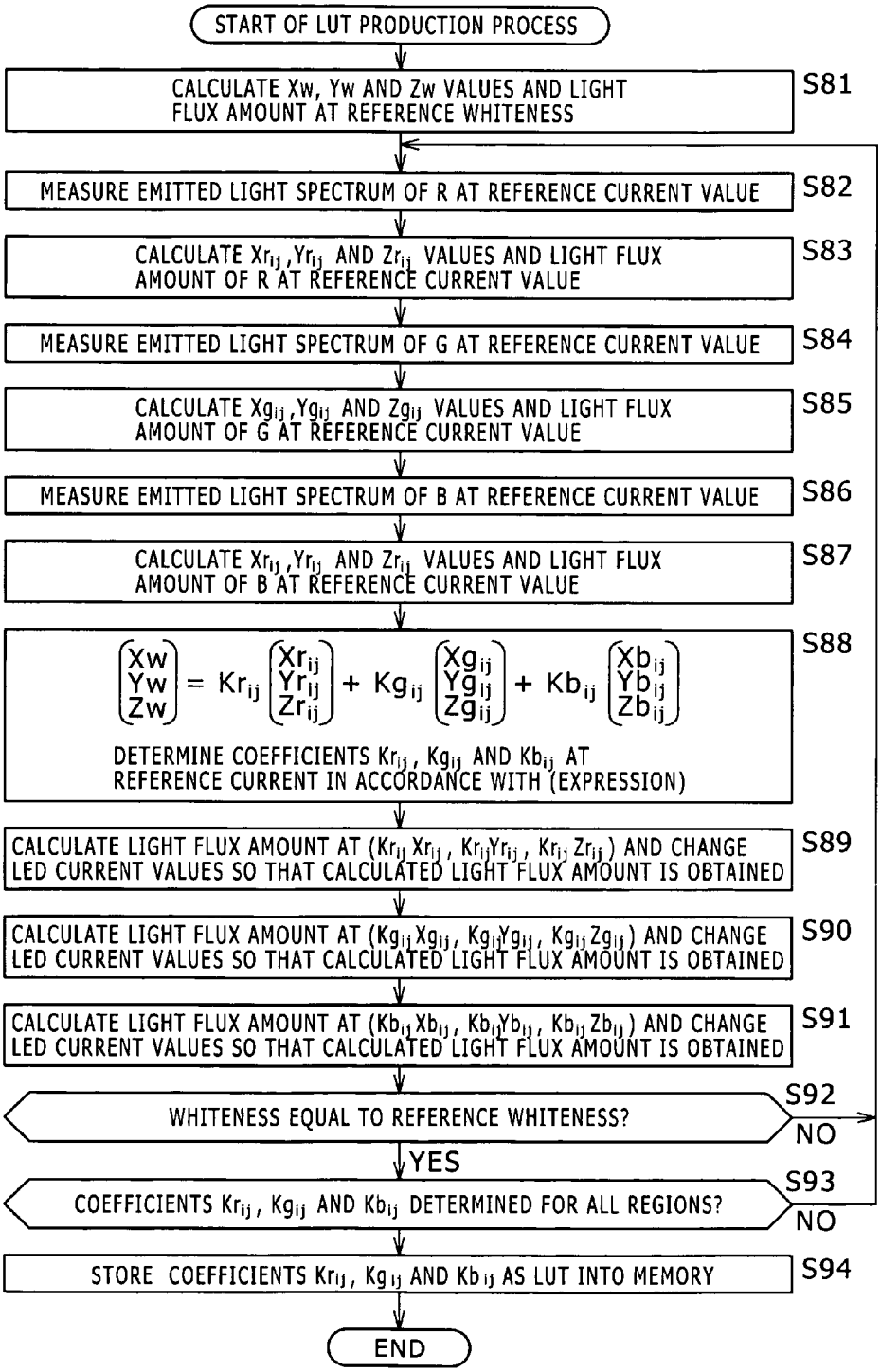

Further, a combination of LED current values with which the reference whiteness is obtained may otherwise be determined by an LUT production process illustrated in FIG. 9. In particular, FIG. 9 shows a flow chart of a further LUT production process by the light source control circuit 32.

Referring to FIG. 9, first at step S81, the chromaticity control section 62 calculates Xw, Yw and Zw values of a reference whiteness and a light flux amount. Here, the Xw, Yw and Zw values are X, Y and Z values of the reference whiteness in the CIE 1931 XYZ calorimetric system. Further, $Xr_{ij}$, $Yr_{ij}$ and $Zr_{ij}$ values, $Xg_{ij}$, $Yg_{ij}$ and $Zg_{ij}$ values and $Xb_{ij}$, $Yb_{ij}$ and $Zb_{ij}$ values hereinafter described represent X, Y and Z values of R, G and B in the CIE 1931 XYZ calorimetric system observed in the region $A_{ij}$.

Further, at step S81, the pulse width determination section 71 supplies a pulse width W determined in advance as a pulse width for color adjustment to the pulse generation section 72. The pulse generation section 72 generates a pulse signal having the pulse width W supplied thereto from the pulse width determination section 71 to the switching device 53 of the region $A_{ij}$.

At step S82, the current value determination section 75 measures the generated light spectrum mW/nm of R at the reference current value. Then at step S83, the current value determination section 75 calculates $Xr_{ij}$, $Yr_{ij}$ and $Zr_{ij}$ values and the light flux amount at the reference current value.

At step S84, the current value determination section 75 measures the generated light spectrum mW/nm of G at the reference current value. Then at step S85, the current value determination section 75 calculates $Xg_{ij}$, $Yg_{ij}$ and $Zg_{ij}$ values and the light flux amount at the reference current value.

At step S86, the current value determination section 75 measures the generated light spectrum mW/nm of B at the reference current value. Then at step S87, the current value determination section 75 calculates $Xb_{ij}$, $Yb_{ij}$ and $Zb_{ij}$ values and the light flux amount at the reference current value.

At step S88, the current value determination section 75 calculates coefficients $Kr_{ij}$, $Kg_{ij}$ and $Kb_{ij}$ for the reference current value in accordance with:

$$\begin{pmatrix} Xw \\ Yw \\ Zw \end{pmatrix} = Kr_{ij}\begin{pmatrix} Xr_{ij} \\ Yr_{ij} \\ Zr_{ij} \end{pmatrix} + Kg_{ij}\begin{pmatrix} Xg_{ij} \\ Yg_{ij} \\ Zg_{ij} \end{pmatrix} + Kb_{ij}\begin{pmatrix} Xb_{ij} \\ Yb_{ij} \\ Zb_{ij} \end{pmatrix} \quad \text{[Expression 1]}$$

At step S89, the current value determination section 75 calculates the light flux amount at ($Kr_{ij}Xr_{ij}$, $Kr_{ij}Yr_{ij}$, $Kr_{ij}Zr_{ij}$) and changes the LED current value $IR_{ij}$ for R so that it becomes equal to the calculated light flux amount. For example, the current value determination section 75 calculates the light flux amount at ($Kr_{ij}Xr_{ij}$, $Kr_{ij}Yr_{ij}$, $Kr_{ij}Zr_{ij}$) and successively increments the LED current value $IR_{ij}$ until it becomes equal to the calculated light flux amount.

At step S90, the current value determination section 75 calculates the light flux amount at ($Kg_{ij}Xg_{ij}$, $Kg_{ij}Yg_{ij}$, $Kg_{ij}Zg_{ij}$) and changes the LED current value $IG_{ij}$ for G so that it becomes equal to the calculated light flux amount.

At step S91, the current value determination section 75 calculates the light flux amount at ($Kb_{ij}Xb_{ij}$, $Kb_{ij}Yb_{ij}$, $Kb_{ij}Zb_{ij}$) and changes the LED current value $IR_{ij}$ for B so that it becomes equal to the calculated light flux amount.

At step S92, the current value determination section 75 decides whether or not the whiteness of light from the LEDs 51R, 51G and 51B of the region $A_{ij}$ is equal to the reference whiteness.

If it is decided at step S92 that the whiteness of light from the LEDs 51R, 51G and 51B of the region $A_{ij}$ is not equal to the reference whiteness, then the processing returns to step S82 so that the processing at steps S83 to S92 is executed again. It is to be noted that, in the processing at steps S82 to S88 in the second or later cycle, not the reference current value but the current value set at steps S89 to S91 is used to execute the processing.

On the other hand, if it is decided at step S92 that the whiteness of light from the LEDs 51R, 51G and 51B of the region $A_{ij}$ is equal to the reference whiteness, then the current value determination section 75 decides at step S93 whether or not the LED current values with which the reference whiteness is obtained are determined for all regions of the backlight 12.

If it is decided at step S93 that the LED current values with which the reference whiteness is obtained are not determined for all regions of the backlight 12, then the processing returns to step S82 to execute the processes at steps S82 to S93 described hereinabove for a region $A_{ij}$ whose LED current values with which the reference whiteness is obtained are not determined as yet. As a result, the LED current values $IR_{ij}$, $I_{G0}$ and $IB_{ij}$ of the region $A_{ij}$ whose LED current values with which the reference whiteness is obtained are not determined as yet are determined.

On the other hand, if it is decided at step S93 that the LED current values with which the reference whiteness is obtained are determined for all regions of the backlight 12, then the current value determination section 75 stores, at step S94, the LED current values $IR_{ij}$, $IG_{ij}$ and $IB_{ij}$ and the coefficients $Kr_{ij}$, $Kg_{ij}$ and $Kb_{ij}$ with which the whiteness and the light emission luminance become equal among all of the light sources $BL_{11}$ to $BL_{56}$ as an LUT into the memory 73. Then, the processing is ended.

As described above, in the liquid crystal display apparatus 1, LED current values adjusted in advance so that all of the light sources $BL_{11}$ to $BL_{56}$ emit light of an equal whiteness and an equal light emission luminance are supplied to the LEDs 51R, 51G and 51B of all of the regions $A_{ij}$. Further, in the liquid crystal display apparatus 1, the light emission luminance of each region $A_{ij}$ can be made equal among the LEDs 51R, 51G and 51B of each region $A_{ij}$. Accordingly, control which suppresses unnecessary light emission luminance can be performed simply while light is emitted with an equal whiteness over the overall area of the lighting region of the backlight 12. Further, since unnecessary light emission luminance is suppressed in response to an inputted image signal, low power consumption and a high contrast ratio can be implemented.

It is to be noted that, in the present specification, the steps described in the flow charts may be but need not necessarily be processed in a time series in the order as described, and include processes which are executed in parallel or individually without being processed in a time series.

While a preferred embodiment of the present invention has been described using specific terms, such description is for illustrative purpose only, and it is to be understood that changes and variations may be made without departing from the spirit or scope of the following claims.

What is claimed is:

1. A backlight apparatus for controlling a backlight wherein light emitting devices (LEDs) for emitting light of a plurality of colors and a switching device for switching on or off light emission of said light emitting devices are provided for divisional regions formed by division of a lighting region such that a light emission luminance can be varied for the divisional regions, said backlight apparatus comprising:

light emission luminance control means for varying a pulse width of a pulse signal to be supplied to a switching device in a first of the divisional regions to control the light emission luminance of the light emitted by a plurality of LEDs of the first divisional region, the plurality of LEDs being configured to emit light of the plurality of colors;

current value storage means for storing, for the first divisional region, current values of currents to be supplied to the plurality of LEDs, the current values being determined such that a whiteness and the light emission luminance of the light emitted by the plurality of LEDs become equal to predetermined values; and current control means for controlling a power supplying means for supplying the currents to the plurality of LEDs so that the currents become equal to the current values stored in said current value storage means, wherein the switching device is configured to switch the plurality of LEDs in response to a same signal, the same signal being the pulse signal, wherein the plurality of LEDs includes a first LED configured to emit light of a first color and a second LED configured to emit light of a second color, wherein the light emission luminance control means is configured to adjust the light emission luminance of the light emitted by the plurality of LEDs from a first luminance value to a second luminance value by controlling the switching device to adjust a same rate at which the plurality of LEDs switch on and off from a first same rate value to a second same rate value, the first luminance value having a corresponding first chromaticity and the second luminance value having a corresponding second chromaticity, and wherein the current control means is configured to control chromaticity from the first luminance value to the second luminance value by providing current values to the first LED and the second LED that are different for at least one of the first chromaticity or the second chromaticity.

2. The backlight apparatus according to claim 1, further comprising a current value determination section for determining the current values based on the whiteness and the light emission luminance of the light emitted by the plurality of LEDs.

3. The backlight apparatus according to claim 2, wherein the current values of the currents to be supplied to the plurality of LEDs are first current values, wherein the plurality of LEDs are a first plurality of LEDs, and wherein:

the current value storage means is also for storing second current values of currents to be supplied to a second plurality of LEDs in a second of the divisional regions, and the current value determination section is configured to determine the second current values by:

calculating coefficients relating light emission luminance of the second divisional region to the light emission luminance of the first divisional region, determining the second current values such that a whiteness of light emitted by the second plurality of LEDs becomes equal to a predetermined value, and adjusting the second current values based on the coefficients such that the light emission luminance of the light emitted by the second plurality of LEDs becomes equal to the light emission luminance of the light emitted by the first plurality of LEDs.

4. The backlight apparatus according to claim 1, wherein the plurality of LEDs comprises an LED configured to emit light of a red color, an LED configured to emit light of a blue color, and an LED configured to emit light of a green color.

5. The backlight apparatus according to claim 1, wherein:

the switching device in the first divisional region comprises a switch for controlling the light emission luminance of the light emitted by the plurality of LEDs of the first divisional region, and the pulse signal is supplied to the switch.

6. The backlight apparatus according to claim 1, wherein the switching device in the first divisional region comprises a plurality of switches.

7. The backlight apparatus according to claim 1, wherein the switching device includes a single switch to which the plurality of LEDs are coupled, the plurality of LEDs being configured to emit light of the plurality of colors.

8. A backlight controlling method wherein light emitting devices (LEDs) for emitting light of a plurality of colors and a switching device for switching on or off light emission of said light emitting devices are provided for divisional regions formed by division of a lighting region such that a light emission luminance can be varied for the divisional regions, said backlight controlling method comprising acts of:

varying a pulse width of a pulse signal to be supplied to a switching device in a first of the divisional regions to control the light emission luminance of the light emitted by a plurality of LEDs of the first divisional region, the plurality of LEDs being configured to emit light of the plurality of colors;

controlling a power supplying section supplying currents to the plurality of LEDs so that the currents become equal to stored current values with which a whiteness and the light emission luminance of the light emitted by the plurality of LEDs become equal to predetermined values, wherein the switching device switches the plurality of LEDs in response to a same signal, the same signal being the pulse signal, wherein the plurality of LEDs includes a first LED configured to emit light of a first color and a second LED configured to emit light of a second color, wherein the method further comprises adjusting the light emission luminance of the light emitted by the plurality of LEDs from a first luminance value to a second luminance value by controlling the switching device to adjust a same rate at which the plurality of LEDs switch on and off from a first same rate value to a second same rate value, the first luminance value having a corresponding first chromaticity and the second luminance value having a corresponding second chromaticity, and wherein the current values to the first LED and the second LED are different for at least one of the first chromaticity or the second chromaticity.

9. The backlight controlling method according to claim 8, wherein the current values of the currents to be supplied to the plurality of LEDs are first current values, wherein the plurality of LEDs are a first plurality of LEDs, and wherein:

the method further comprises determining second current values of currents to be supplied to a second plurality of LEDs in a second of the divisional regions by:

calculating coefficients relating light emission luminance of the second divisional region to the light emission luminance of the first divisional region, determining the second current values such that a whiteness of light emitted by the second plurality of LEDs becomes equal to a predetermined value, and adjusting the second current values based on the coefficients such that the light emission luminance of the light emitted by the second plurality of LEDs becomes equal to the light emission luminance of the light emitted by the first plurality of LEDs.

10. The backlight controlling method according to claim 8, wherein the plurality of LEDs comprises an LED configured to emit light of a red color, an LED configured to emit light of a blue color, and an LED configured to emit light of a green color.

11. The backlight controlling method according to claim 8, wherein:

the switching device in the first divisional region comprises a plurality of switches.

12. The backlight controlling method according to claim 8, wherein:

the switching device in the first divisional region comprises a first switch for controlling light emission luminance of light emitted by the first LED, and a second switch for controlling light emission luminance of light emitted by the second LED, and the pulse signal is supplied to the first and second switches.

13. The backlight controlling method according to claim 8, further comprising adjusting the whiteness of the light emitted by the plurality of LEDs by adjusting values of the currents supplied to the plurality of LEDs while switching the plurality of LEDs on and off at the same rate.

14. A liquid crystal display apparatus, comprising:

a backlight wherein light emitting devices (LEDs) configured to emit light of a plurality of colors and a switching device for switching on or off light emission of said light emitting devices are provided for divisional regions formed by division of a lighting region such that a light emission luminance can be varied for the divisional regions;

light emission luminance control means for varying a pulse width of a pulse signal to be supplied to a switching device in a first of the divisional regions to control the light emission luminance of the light emitted by a plurality of LEDs of the first divisional region, the plurality of LEDs being configured to emit light of the plurality of colors;

current value storage means for storing, for the first divisional region, current values of currents to be supplied to the plurality of LEDs, the current values being determined such that a whiteness and the light emission luminance of the light emitted by the plurality of LEDs become equal to predetermined values; and current control means for controlling a power supplying means for supplying the currents to be supplied to the plurality of LEDs so that the currents become equal to the current values stored in said current value storage means, wherein the switching device is configured to switch the plurality of LEDs in response to a same signal, the same signal being the pulse signal, wherein the plurality of LEDs includes a first LED configured to emit light of a first color and a second LED configured to emit light of a second color, wherein the light emission luminance control means is configured to adjust the light emission luminance of the light emitted by the plurality of LEDs from a first luminance value to a second luminance value by controlling the switching device to adjust a same rate at which the plurality of LEDs switch on and off from a first same rate value to a second same rate value, the first luminance value having a corresponding first chromaticity and the second luminance value having a corresponding second chromaticity, and wherein the current control means is configured to control chromaticity from the first luminance value to the second luminance value by providing current values to the first LED and the second LED that are different for at least one of the first chromaticity or the second chromaticity.

15. The liquid crystal display apparatus according to claim 14, wherein the current values of the currents to be supplied to the plurality of LEDs are first current values, wherein the plurality of LEDs are a first plurality of LEDs, and wherein:

the current value storage means is also for storing second current values of currents to be supplied to a second plurality of LEDs in a second of the divisional regions, and the liquid crystal display apparatus further comprises a current value determination section configured to determine the second current values by:

calculating coefficients relating light emission luminance of the second divisional region to the light emission luminance of the first divisional region, determining the second current values such that a whiteness of light emitted by the second plurality of LEDs becomes equal to a predetermined value, and adjusting the second current values based on the coefficients such that the light emission luminance of the light emitted by the second plurality of LEDs becomes equal to the light emission luminance of the light emitted by the first plurality of LEDs.

16. The liquid crystal display apparatus according to claim 14, wherein the plurality of LEDs comprises an LED configured to emit light of a red color, an LED configured to emit light of a blue color, and an LED configured to emit light of a green color.

17. The liquid crystal display apparatus according to claim 14, wherein:

the switching device in the first divisional region comprises a plurality of switches.

18. The liquid crystal display apparatus according to claim 14, Wherein:

the switching device in the first divisional region comprises a first switch for controlling light emission luminance of light emitted by the first LED and a second switch for controlling light emission luminance of light emitted by the second LED, and the pulse signal is supplied to the first and second switches.

19. A backlight apparatus for controlling a backlight wherein light emitting devices (LEDs) for emitting light of a plurality of colors and a switching device for switching on or off light emission of said light emitting devices are provided for divisional regions formed by division of a lighting region such that a light emission luminance can be varied for the divisional regions, said backlight apparatus comprising:

a light emission luminance control section configured to vary a pulse width of a pulse signal to be supplied to a switching device in a first of the divisional regions to control the light emission luminance of the light emitted by a plurality of LEDs of the first divisional region, the plurality of LEDs being configured to emit light of the plurality of colors;

a current value storage section configured to store, for the first divisional region, current values of currents to be supplied to the plurality of LEDs, the current values being determined such that a whiteness and the light emission luminance of the light emitted by the plurality of LEDs become equal to predetermined values; and a current control section configured to control a power supply section to control the currents to be supplied to the plurality of LEDs so that the currents become equal to the current values stored in said current value storage section, wherein the switching device is configured to switch the plurality of LEDs in response to a same signal, the same signal being the pulse signal, wherein the plurality of LEDs includes a first LED configured to emit light of a first color and a second LED configured to emit light of a second color, wherein the light emission luminance control section is configured to adjust the light emission luminance of the light emitted by the plurality of LEDs from a first luminance value to a second luminance value by controlling the switching device to adjust a same rate at which the plurality of LEDs switch on and off from a first same rate value to a second same rate value, the first luminance value having a corresponding first chromaticity and the second luminance value having a corresponding second chromaticity, and wherein the current control section is configured to control chromaticity from the first luminance value to the second luminance value by providing current values to the first LED and the second LED that are different for at least one of the first chromaticity or the second chromaticity.

20. The backlight apparatus according to claim 19, wherein the current values of the currents to be supplied to the plurality of LEDs are first current values, wherein the plurality of LEDs are a first plurality of LEDs, and wherein:

the current value storage section is further configured to store second current values of currents to be supplied to a second plurality of LEDs in a second of the divisional regions, and the backlight apparatus further comprises a current value determination section configured to determine the second current values by:

calculating coefficients relating light emission luminance of the second divisional region to the light emission luminance of the first divisional region, determining the second current values such that a whiteness of light emitted by the second plurality of LEDs becomes equal to a predetermined value, and adjusting the second current values based on the coefficients such that the light emission luminance of the light emitted by the second plurality of LEDs becomes equal to the light emission luminance of the light emitted by the first plurality of LEDs.

21. The backlight apparatus according to claim 19, wherein:

the switching device in the first divisional region comprises a switch for controlling the light emission luminance of the light emitted by the plurality of LEDs of the first divisional region, and the pulse signal is supplied to the switch.

22. The backlight apparatus according to claim 19, wherein the switching device in the first divisional region comprises a plurality of switches.

23. The backlight apparatus according to claim 19, wherein the current control section is further configured to adjust the whiteness of the light emitted by the plurality of LEDs by adjusting values of the currents supplied to the plurality of LEDs while the plurality of LEDs switch on and off at the same rate.

* * * * *